US006851247B1

(12) United States Patent
Turner et al.

(10) Patent No.: US 6,851,247 B1
(45) Date of Patent: Feb. 8, 2005

(54) COMPOSITE UTILITY POLE CORE SYSTEMS

(75) Inventors: Daryl V. Turner, Scottsdale, AZ (US); Dennis M. Danzik, Scottsdale, AZ (US)

(73) Assignee: D² LLC, Las Vegas, NV (US)

( * ) Notice: Subject to any disclaimer, the term of this patent is extended or adjusted under 35 U.S.C. 154(b) by 0 days.

(21) Appl. No.: 10/108,750

(22) Filed: Mar. 25, 2002

Related U.S. Application Data

(60) Provisional application No. 60/278,221, filed on Mar. 23, 2001.

(51) Int. Cl.[7] ..... E04C 3/30

(52) U.S. Cl. ..... 52/736.3; 52/726.4; 52/738.1

(58) Field of Search ..... 52/726.4, 736.1, 52/736.2, 736.3, 40, 731.4, 732.3, 738.1

(56) References Cited

U.S. PATENT DOCUMENTS 1,350,686 A * 8/1920 Trudelle
3,013,584 A * 12/1961 Reed et al.
3,461,593 A * 8/1969 Martuch et al.
3,574,104 A * 4/1971 Medler
3,813,837 A * 6/1974 McClain et al.
3,989,396 A * 11/1976 Matsumoto et al.
4,024,666 A * 5/1977 Carver
4,246,732 A * 1/1981 Frehner
4,700,751 A * 10/1987 Fedrick
4,912,901 A * 4/1990 Jerry ..... 52/301
5,471,809 A * 12/1995 Frankel ..... 52/737.4
5,555,696 A * 9/1996 Morrison ..... 52/737.1
5,862,642 A * 1/1999 Erwin
5,870,877 A * 2/1999 Turner ..... 52/736.3
6,054,197 A * 4/2000 Rastegar
6,058,675 A * 5/2000 MacDonald ..... 52/736.1
6,155,017 A * 12/2000 Turner ..... 52/726.4
6,257,997 B1 * 7/2001 Doble et al.
6,394,909 B1 * 5/2002 Laibangyang
6,467,756 B1 * 10/2002 Elasser

FOREIGN PATENT DOCUMENTS

WO WO 01/02662 A2 * 1/2001 ..... E04C/3/00

* cited by examiner

*Primary Examiner*—Robert Canfield
(74) *Attorney, Agent, or Firm*—Blakely, Sokoloff, Taylor & Zafman LLP

(57) ABSTRACT

Composite utility pole core systems wherein at least one core member fits within, but is not bonded to, the composite pole. The core systems provide increased bending strength in a hollow composite pole by preventing collapse of the cross section of the pole, the normal precursor to failure in bending of a tubular structure. The core members may be separately manufactured, and used individually or in plurality, being spaced equally along the length of the pole, or spaced unevenly, using closer spacing in the lower regions of the utility pole where bending stress are likely to be the largest.

38 Claims, 5 Drawing Sheets

Figure 1:
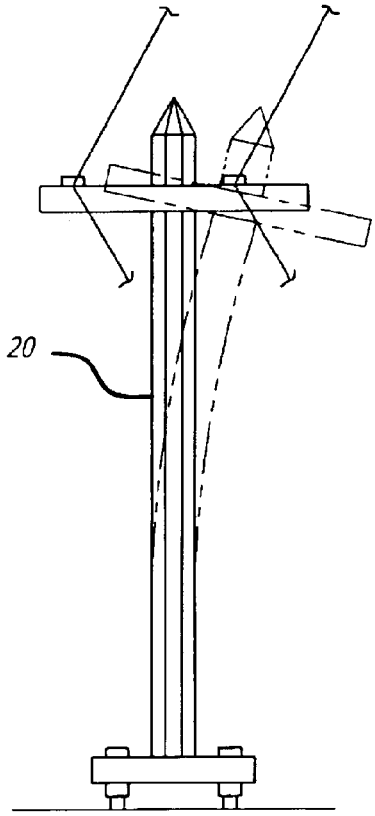
FIG. 1 (Prior Art)

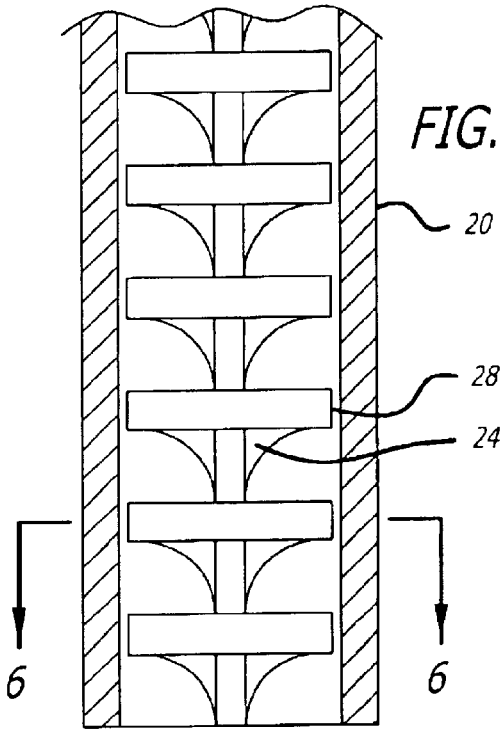
FIG. 4
FIG. 5
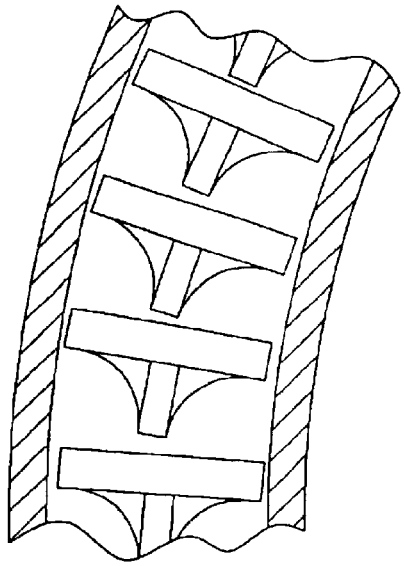
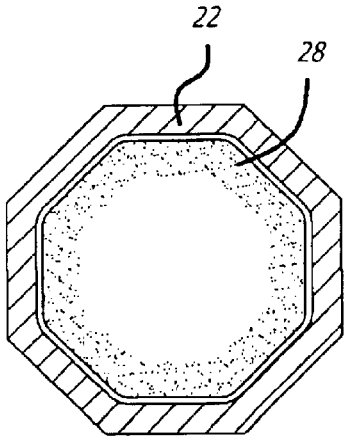
FIG. 6
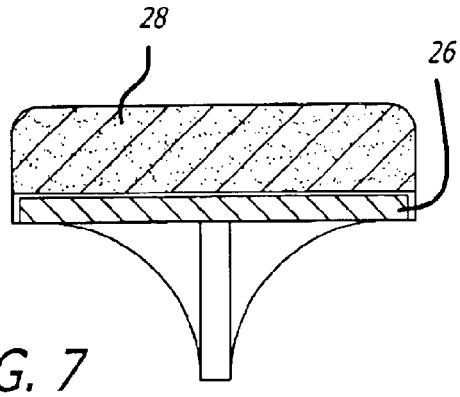
FIG. 7

COMPOSITE UTILITY POLE CORE SYSTEMS

CROSS-REFERENCE TO RELATED APPLICATIONS

This application claims the benefit of U.S. Provisional Patent Application No. 60/278,221 filed on Mar. 23, 2001.

BACKGROUND OF THE INVENTION

Composite utility poles have recently been introduced to offer various advantages over other types of poles historically used or more recently introduced. Such composite utility poles are hollow structures having a polygonal-shaped outer surface and an inner channel fabricated of rovings of fibers located in a zero degree orientation and layers of fibers or mats embedded in resin. The poles are ultraviolet light resistant, corrosion resistant, resistant to bugs, birds and the like, and are not subject to rot.

In such composite pole structures, it is desired to minimize the amount of material required for the fabrication of the pole while still maintaining accurate strength, as weight and cost are both highly dependent on the amount of each material used.

In normal use, utility poles may be subject to various forces, some of which are relatively constant, some of which are dependent upon and vary with the environment and some of which will vary dependent upon the position and application of the pole in the system. By way of example, poles are normally required to carry their own weight, the weight of one or more cross-arms and the weight of the wires supported thereby. Additionally, they may encounter the weight of a transformer or other parts of the distribution system. Variable forces include, the weight of birds perched on the wires, and the unequal tension in the wires because of the birds, windage, snow and ice on the pole, cross-arms, wires and any other components supported thereby such as by way of example, transformers. Other forces that may be encountered by utility poles include side forces arising from the fact that utility poles are not always placed directly inline with each other. By way of example, utility poles positioned along a curving street will similarly be positioned in a curved arc so that the tension on the wires together with any increased tension due to birds on the wires, etc. will provide a side force adjacent the top of the pole, tending to pull the top of the pole toward the center of the curve. Since horizontal forces at the top of a pole create large bending moments along the pole and particularly at the base of the pole, it is particularly important that such composite poles have adequate resistance to such bending moments without failure of the structural integrity of the pole. As a further illustration of a situation wherein high horizontal forces, may be exerted on a pole, consider a windstorm situation wherein trees fall across power lines (or phone lines). Preferably, the wires will fail, but the poles will be left standing. Further, however, it is important that with wires on one side of the pole being severed, the tension in the wires on the other side of the pole, given windage, perhaps ice accumulation, etc. will not cause a failure in the pole, as otherwise a domino effect may be encountered where each pole in a row would fail one after another.

Because of the aspect ratio of a typical utility pole is high, the high bending moments encountered along the pole and particularly adjacent the bottom of the pole normally impose more severe structural requirements on the pole than are imposed by the weight of the structure, wire, birds, etc. that must be supported by the pole through the compressive loads imposed thereon.

DETAILED DESCRIPTION OF THE PREFERRED EMBODIMENT

First referring to FIG. 1, an illustration of a composite utility pole shown standing upright and shown in phantom with the exaggerated deflection to the side as might be caused by tension in the wires extending to adjacent utility poles which are not co-linear with the pole shown, wind forces, etc. may be seen. Though the deflection is exaggerated, it does illustrate the point that the bending moments due to horizontal forces adjacent to the top of the pole cause maximum bending moments adjacent to the bottom of the pole.

Figure 2:
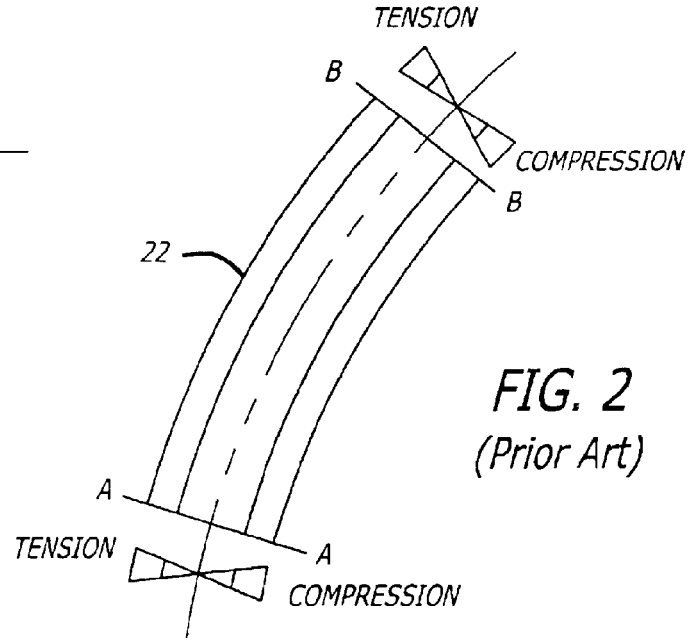
FIG. 2 (Prior Art)
Figure 3:
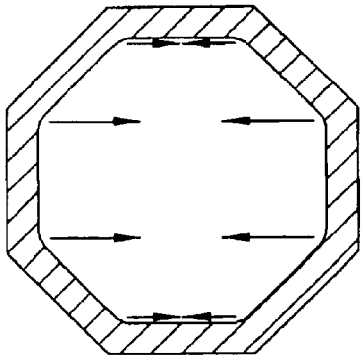
FIG. 3 (Prior Art)

FIG. 2 schematically illustrates a section 22 of pole 20 in a high bending moment region of the pole. Assuming that pole 20 is unstressed when standing vertically (therefore neglecting the compressive stresses on the pole), it may be seen from FIG. 2 that part of the pole on one side of the neutral axis is in tension and the other part of the pole on the other side of the neutral axis, in compression. Further, the tensile forces at section B—B are not collinear with the tensile forces at section A—A, with the net effect of the resultant forces pushing inward on the cross-sectional of the beam. Similarly, the compressive forces on sections A—A and B—B also do not align, the same also creating resultant forces pushing inward on the opposite side of the beam. These forces are illustrated in FIG. 3. In that regard, for the specific composite beam illustrated, the outer corner are filled with pre-stressed longitudinal rovings and accordingly, the forces shown in FIG. 3 have been drawn through those corner regions, though in fact the forces will be more distributed around the cross-section of the pole. Also, while the pre-stressing of the rovings and/or fabrics and rovings in the rest of the cross-section complicates the analysis, a point to be made is that when one end of a pole is held and a lateral force is applied to the other end of the pole, structural failure of the pole will occur not by the failure of the rovings, etc. in tension on the outside of the curvature of the pole or failure of the structure in compression on the inside of the curvature of the pole, but rather by the cross-section of the pole collapsing due to the forces illustrated in FIG. 3. When the cross section collapses, the pole easily bends around the collapsed cross-section, much like a soda straw will collapse and easily bend once its bending resistance is exceeded. Accordingly, the purpose of the present invention is to provide simple means for maintaining the integrity of the cross-section of the composite pole structure, either eliminating or grossly reducing one of the most prominent failure modes in such composite utility poles. This allows the fabrication of lighter poles, reducing costs and resulting in poles that may be more easily handled, erected, etc.

In accordance with the present invention, provisions are made to maintain the cross section of the interior of the pole at substantially its original cross section at various positions spaced along the length of the pole. The effect of this may be envisioned from FIG. 2. Assume by way of example that the cross-section of the pole is to be maintained at sections A—A and B—B. With respect to the part of the pole which is in tension, and recognizing that a curvature between sections A—A and B—B is exaggerated, it may be seen that any distortion of the cross-section due to tension in that part of the beam will tend to somewhat straighten out the part of the beam in tension between regions where the cross-section is maintained. This limits the extent of distortion of the cross-section that is possible. With respect to the part of the beam that is in compression between sections A—A and B—B, the same may be thought of as a slightly curved column. Provided the length of the column is purposely and adequately limited, the same may be caused to fail in compression rather than buckling inward. Thus if the cross-section of the pole is maintained in spaced apart areas which are sufficiently close together, pole strength may be grossly increased (or material requirements decreased) so that the pole strength approaches or is equal to that resulting from compressive failure or tensile failure of the pole and not loss of integrity of the cross-section of the pole. In that regard, since the outermost structure of the cross section of FIG. 3 are the corners of the cross-section having the longitudinal rovings in tension, much of the compression on the inside of the curvature of the beam is in fact a reduction in the tension in those rovings, further inhibiting a loss of cross-section integrity of the pole between spaced apart regions where that integrity is enforced.

Figure 8:
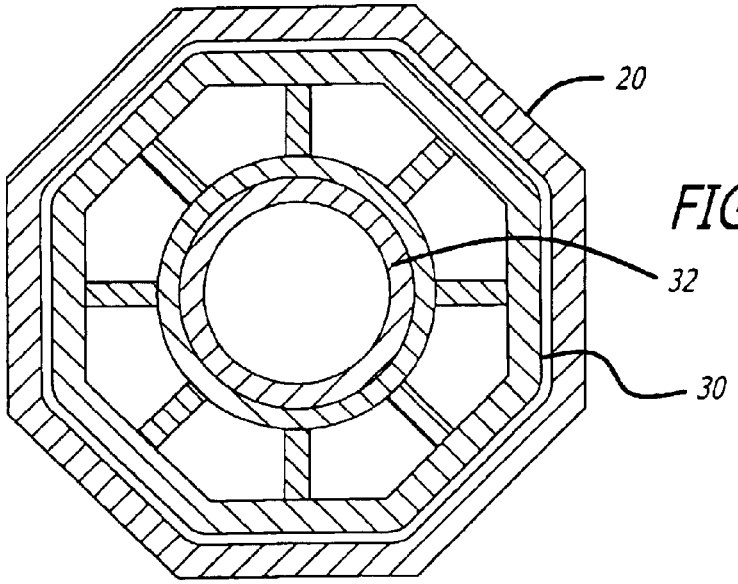
Figure 10:
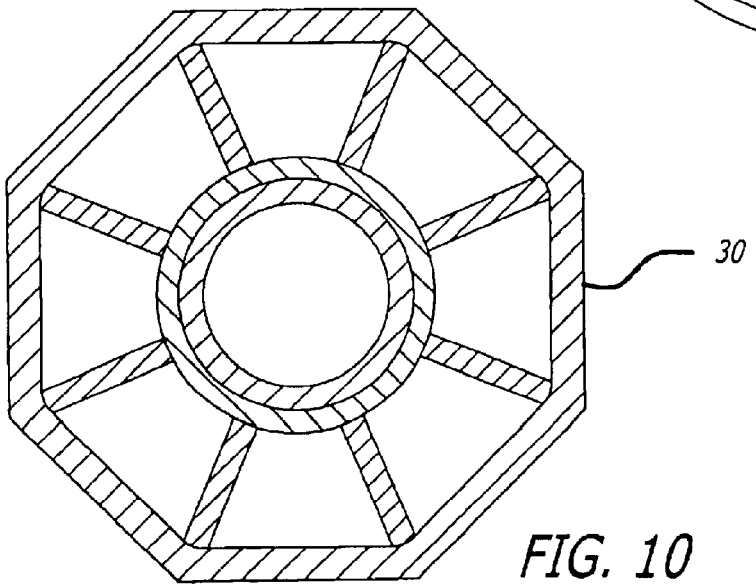

FIGS. 4, 5, 6 and 7 illustrate one embodiment of the invention. In this embodiment, rigid foam members 28 just fitting within the inside of a pole 20 are provided, the foam members 28 being supported on a pedestal-like structure 24 holding the foam members 28 in spaced apart positions along the length of the polo. Alternatively, these members may be placed only in the lower sections of a pole where the bending moment is the largest. The pedestals 24 may be a foam member integrally molded with foam members 28 or of a different material. As an alternative, multiple pedestals and foam members may be molded as one piece, the pedestal members being free to break, if they will, where they arm joined to adjacent foam members 28 as illustrated in FIG. 5, during deflection of the pole. In that regard, preferably the foam members 28 have a sufficient thickness in the vertical direction to maintain themselves substantially coaxial with the axis of the pole to avoid cocking within the pole. If desired, a rigid plastic, plywood, or other member 26 may be inserted or molded in place to provide additional rigidity to the foam members 28, though stress concentrations on the inner wall of the pole preferably should be avoided FIGS. 8 and 10 illustrate another embodiment of the present invention. As may be seen in FIG. 10, a rigid plastic member 30 is molded with a spoked wheel-like structure, with the periphery of the wheel just fitting within the inner periphery of the pole 20. These wheel-like members are molded with an adequate thickness in the vertical direction to distribute the pole cross section retaining forces along the local area of the polo so as to avoid stress concentrations of a point contact. These plastic members may be molded, by way of example, from reground plastic, commercially available at a fraction of the cost of new plastic injection molding material. The wheel-like members 30 may be supported in spaced apart positions along the pole 20 by an inner pipe 32 running along the axis of the pole, such as a steel pipe to which spacers are fastened to hold the wheel-like members 30 in spaced apart disposition.

Figure 9:
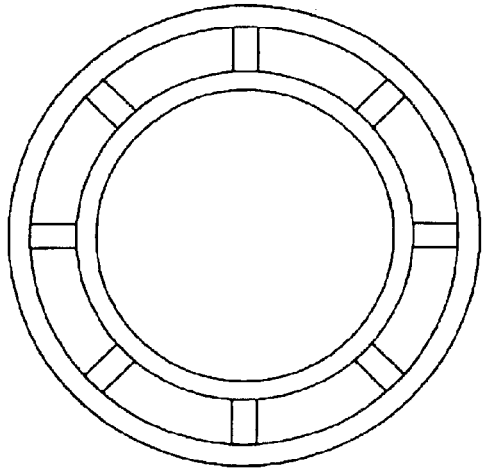

The embodiment of FIG. 9 is similar to the embodiment of FIGS. 8 and 10, though with a round periphery not as accurately matching the inner periphery of the pole 20 of the preferred embodiment. In that regard, the preferred embodiments of the present invention may be used, by way of example, with poles in accordance with U.S. Pat. No. 6,155,017, which may have by way of example, a generally octagonal inner periphery, though with substantially rounded corners.

Figure 11:
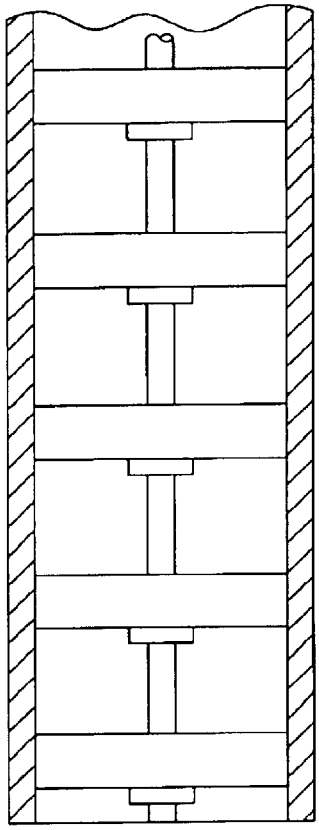
Figure 12:
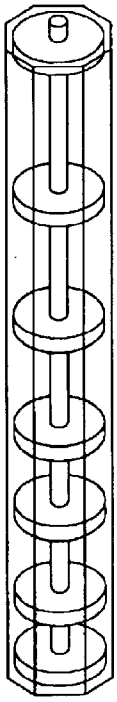
Figure 13:
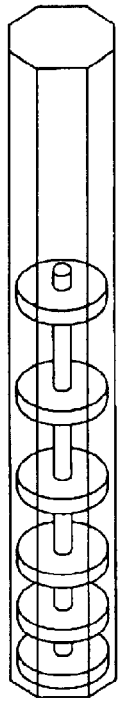
Figure 14:
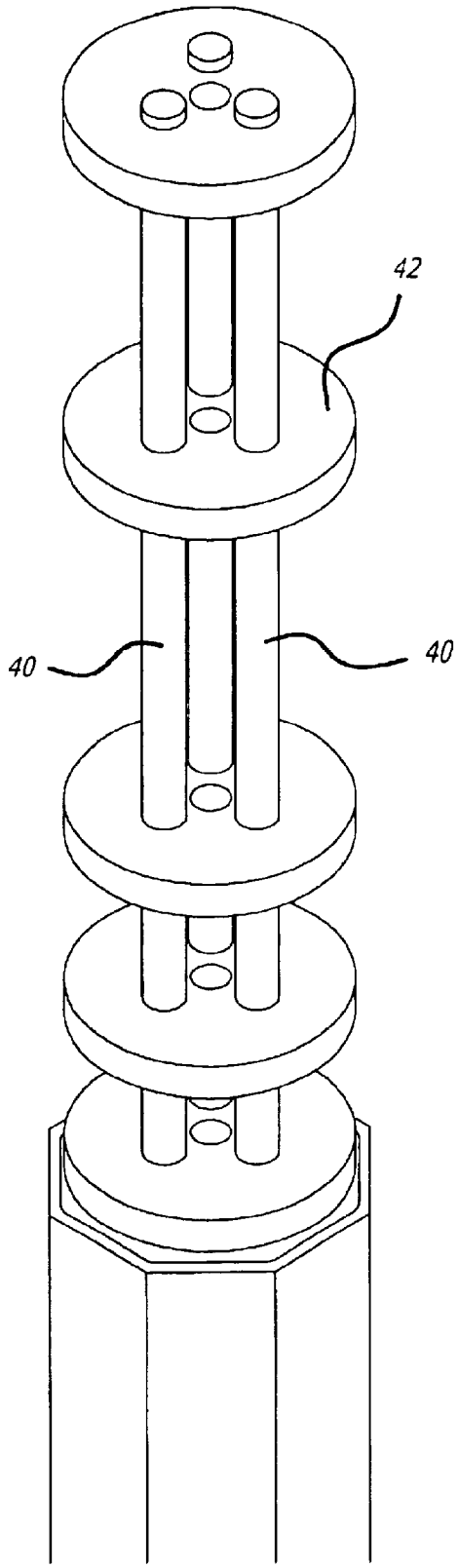
Figure 15:
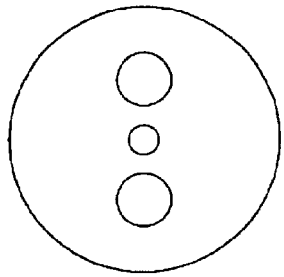
Figure 16:
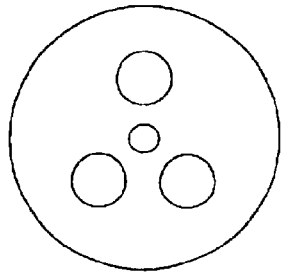
Figure 17:
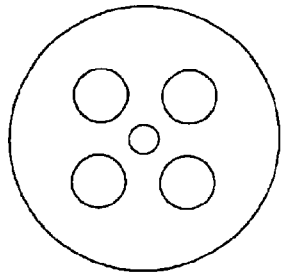

FIGS. 11 through 13 are schematic representations illustrating the possible positioning of the pole core-like structures of the present invention, such as those illustrated in FIGS. 4 through 10. More specifically, FIG. 11 illustrates the uniform positioning of the core members on some form of central pipe or support structure. Such positioning is convenient, though not necessarily the most efficient. FIG. 12 illustrates unequal spacing of core structures of the present invention, the core structures being spaced closer together adjacent the bottom of the pole where bending stresses are the highest, with the spacing increasing going up the pole. FIG. 13 is similar, though with the spaced apart core structures only going partway up the pole in recognition of the fact that bending moments continue to decrease further up the pole while compressive load requirements for load support do not significantly decrease. In that regard, the present invention may be used in poles having a tapered wall thickness along their length or along part of their length, so that the poles' resistance to bending will decrease along their length approximately in proportion to the decrease in the bending moment. In this case, equal spacing of the core structures along the length or along a substantial portion of the length of the poles may be preferred.

FIGS. 14, 15, 16 and 17 illustrate additional core structures, specifically core structures which are held in spaced apart position on multiple pipes or tubes 40, such as in the examples shown, 2, 3 or 4, such pipes or tubes preferably rigidly connecting the core members 42 on pipes 40. Such pipes, which may be by way of example, steel pipes, will provide further resistance to bending of the pole in addition to that resulting from the spacers maintaining the integrity of the cross section of the pole in the presence of high bending stresses.

The core structures of the present invention may be fabricated in various configurations and from various materials, as desired, including steel, plastic, plastic foam and combinations of such materials.

What is claimed is:

1. A pole structure comprising:

a hollow, elongate pole, the pole having an axis that extends along the length of the pole from a bottom end to a top end, the pole comprising a composite structure comprising high strength filament and a resin; and, a plurality of spaced apart rigid foam core members fitting within and not being bonded to the composite structure, the core members transferring tensile forces on a first side of a neutral axis to a second side of a neutral axis when the pole is subjected to bending moments, the plurality of core members being arranged such that bending moments will cause the hollow pole to fail in compression or tension rather than buckling.

2. The pole structure of claim 1 wherein the pole further comprises pre-stressed longitudinal rovings that extend along the axis.

3. The pole structure of claim 2 wherein the pole has a polygonal cross section and the pre-stressed longitudinal rovings fill the outer corners of the polygon.

4. The pole structure of claim 1 wherein each of the plurality of core members includes a pedestal-like structure holding each foam member in spaced apart position from a foam core member immediately below.

5. The pole structure of claim 1 wherein each of the plurality of foam core members includes a rigid member to provide additional rigidity.

6. The pole structure of claim 1 wherein each of the plurality of core members has a spoked wheel-like structure.

7. The pole structure of claim 1 wherein each of the plurality of core members has a thickness to distribute pole cross section retaining forces along a local area of the pole.

8. The pole structure of claim 1 wherein spacing along the axis of the pole between each pair of adjacent core members is uniform.

9. The pole structure of claim 1 wherein spacing along the axis of the pole between each pair of adjacent core members increases as the pair of adjacent core members is further from the bottom end of the pole.

10. A pole structure comprising:

a hollow, elongate pole, the pole having an axis that extends along the length of the pole from a bottom end to a top end, the cross section forming a composite structure including high strength filament, pre-stressed longitudinal rovings, and a resin; and, a plurality of spaced apart, individual core members fitting within and not being bonded to the composite structure, each of the plurality of core members including a pedestal-like structure holding each core member in spaced apart position from a core member immediately below, the core members transferring tensile forces on a first side of a neutral axis to a second side of a neutral axis when the pole is subjected to bending moments, the plurality of core members being arranged such that bending moments will cause the hollow pole to fail in compression or tension rather than buckling.

11. The pole structure of claim 10 wherein the pole has a polygonal cross section and the pre-stressed longitudinal rovings fill the outer corners of the polygon.

12. The pole structure of claim 10 wherein each of the plurality of core members includes a foam member.

13. The pole structure of claim 10 wherein each of the plurality of core members has a spoked wheel-like structure.

14. The pole structure of claim 10 wherein a height of the pedestal-like structure for each foam member is uniform.

15. The pole structure of claim 10 wherein a height of the pedestal-like structure for each foam member increases as the foam member is further from the bottom end of the pole.

16. A pole structure comprising:

a hollow, elongate pole, the pole having an axis that extends along the length of the pole from a bottom end to a top end, the pole having a polygonal cross section, the cross section forming a composite structure including high strength filament, pre-stressed longitudinal rovings filling the outer corners of the polygon, and a resin; and, a plurality of spaced apart, individual core members fitting within and not being bonded to the composite structure, each of the plurality of core members comprising a rigid foam member and a pedestal-like structure holding each core member in spaced apart position from a core member immediately below, the core members transferring tensile forces on a first side of a neutral axis to a second side of a neutral axis when the pole is subjected to bending moments, the plurality of core members being arranged such that bending moments will cause the hollow pole to fail in compression or tension rather than buckling.

17. The pole structure of claim 16 wherein each of the plurality of core members includes a rigid member to provide additional rigidity to the foam member.

18. The pole structure of claim 16 wherein each of the plurality of foam members has a thickness to distribute pole cross section retaining forces along a local area of the pole.

19. The pole structure of claim 16 wherein a height of the pedestal-like structure for each core member is uniform.

20. The pole structure of claim 16 wherein a height of the pedestal-like structure for each core member increases as the foam member is further from the bottom end of the pole.

21. A pole structure comprising:

a hollow, elongate pole, the pole having an axis that extends along the length of the pole from a bottom end to a top end, the pole comprising a composite structure comprising high strength filament and a resin; and, a plurality of spaced apart core members fitting within and not being bonded to the composite structure, each of the plurality of core members having a spoked wheel-like structure, the core members transferring tensile forces on a first side of a neutral axis to a second side of a neutral axis when the pole is subjected to bending moments, the plurality of core members being arranged such that bending moments will cause the hollow pole to fail in compression or tension rather than buckling.

22. The pole structure of claim 21 wherein the pole further comprises pre-stressed longitudinal rovings that extend along the axis.

23. The pole structure of claim 22 wherein the pole has a polygonal cross section and the pre-stressed longitudinal rovings fill the outer corners of the polygon.

24. The pole structure of claim 21 wherein each of the plurality of core members is a rigid foam member.

25. The pole structure of claim 24 wherein each of the plurality of core members includes a pedestal-like structure holding each foam member in spaced apart position from a foam member immediately below.

26. The pole structure of claim 24 wherein each of the plurality of core members includes a rigid member to provide additional rigidity to the foam member.

27. The pole structure of claim 21 wherein each of the plurality of core members has a thickness to distribute pole cross section retaining forces along a local area of the pole.

28. The pole structure of claim 21 wherein spacing along the axis of the pole between each pair of adjacent core members is uniform.

29. The pole structure of claim 21 wherein spacing along the axis of the pole between each pair of adjacent core members increases as the pair of adjacent core members is further from the bottom end of the pole.

30. A pole structure comprising:

a hollow, elongate pole, the pole having an axis that extends along the length of the pole from a bottom end to a top end, the pole comprising a composite structure comprising high strength filament and a resin; and, a plurality of spaced apart core members fitting within and not being bonded to the composite structure, spacing along the axis of the pole between each pair of adjacent core members increasing as the pair of adjacent core members is further from the bottom end of the pole, the core members transferring tensile forces on a first side of a neutral axis to a second side of a neutral axis when the pole is subjected to bending moments, the plurality of core members being arranged such that bending moments will cause the hollow pole to fail in compression or tension rather than buckling.

31. The pole structure of claims 30 wherein the pole further comprises pre-stressed longitudinal rovings that extend along the axis.

32. The pole structure of claim 31 wherein the pole has a polygonal cross section and the pre-stressed longitudinal rovings fill the outer corners of the polygon.

33. The pole structure of claim 30 wherein each of the plurality of core members is a rigid foam member.

34. The pole structure of claim 33 wherein each of the plurality of core members includes a pedestal-like structure holding each foam member in spaced apart position from a foam core member immediately below.

35. The pole structure of claim 33 wherein each of the plurality of core members includes a rigid member to provide additional rigidity to the foam member.

36. The pole structure of claim 30 wherein each of the plurality of core members has a spoked wheel-like structure.

37. The pole structure of claim 30 wherein each of the plurality of core members has a thickness to distribute pole cross section retaining forces along a local area of the pole.

38. The pole structure of claim 30 wherein spacing along the axis of the pole between each pair of adjacent core members is uniform.

* * * * *